US009255310B2

(12) United States Patent
Sakurai et al.

(10) Patent No.: US 9,255,310 B2
(45) Date of Patent: Feb. 9, 2016

(54) CU—MG—P BASED COPPER ALLOY MATERIAL AND METHOD OF PRODUCING THE SAME

(75) Inventors: Takeshi Sakurai, Aizuwakamatsu (JP); Yoshihiro Kameyama, Aizuwakamatsu (JP); Yoshio Abe, Aizuwakamatsu (JP)

(73) Assignee: Mitsubishi Shindoh Co., Ltd., Tokyo (JP)

( * ) Notice: Subject to any disclaimer, the term of this patent is extended or adjusted under 35 U.S.C. 154(b) by 851 days.

(21) Appl. No.: 12/801,359

(22) Filed: Jun. 4, 2010

(65) Prior Publication Data

US 2011/0146855 A1 Jun. 23, 2011

(30) Foreign Application Priority Data

Dec. 23, 2009 (JP) ..... 2009-291542

(51) Int. Cl.
*C22C 9/00* (2006.01)
*H01B 5/02* (2006.01)
*C22F 1/08* (2006.01)

(52) U.S. Cl.
CPC .... *C22C 9/00* (2013.01); *C22F 1/08* (2013.01)

(58) Field of Classification Search
USPC ..... 148/432–436, 682; 420/492, 494, 499
IPC ..... C22C 9/00; C22F 1/08
See application file for complete search history.

(56) References Cited

U.S. PATENT DOCUMENTS 4,290,823 A * 9/1981 Dompas ..... 148/508
5,667,752 A 9/1997 Suzuki et al.

FOREIGN PATENT DOCUMENTS

| | | | |
|---|---|---|---|
| GB | 512142 A | * | 8/1939 |
| JP | 63-203738 A | | 8/1988 |
| JP | 01-180930 A | | 7/1989 |
| JP | 01-309219 A | | 12/1989 |
| JP | 05-082203 A | | 4/1993 |
| JP | 05-311283 A | | 11/1993 |
| JP | 06-340938 A | | 12/1994 |
| JP | 09-157774 A | | 6/1997 |
| JP | 10219372 A | * | 8/1998 |
| JP | 2009-228013 A | | 10/2009 |

OTHER PUBLICATIONS

European Search Report dated May 27, 2011, issued for the corresponding European Patent Application No. 10165351.7.

* cited by examiner

*Primary Examiner* — Sikyin Ip
(74) *Attorney, Agent, or Firm* — Locke Lord LLP; James E. Armstrong, IV; Nicholas J. DiCeglie, Jr.

(57) ABSTRACT

A copper alloy material includes, by mass %, Mg of 0.3 to 2%, P of 0.001 to 0.1%, and the balance including Cu and inevitable impurities. An area fraction of such crystal grains that an average misorientation between all the pixels in each crystal grain is less than 4° is 45 to 55% of a measured area, when orientations of all the pixels in the measured area of the surface of the copper alloy material are measured by an EBSD method with a scanning electron microscope of an electron backscattered diffraction image system and a boundary in which a misorientation between adjacent pixels is 5° or more is considered as a crystal grain boundary, and a tensile strength is 641 to 708 N/mm$^2$, and a bending elastic limit value is 472 to 503 N/mm$^2$.

3 Claims, 1 Drawing Sheet

CU—MG—P BASED COPPER ALLOY MATERIAL AND METHOD OF PRODUCING THE SAME

BACKGROUND OF THE INVENTION

1. Field of the Invention

The present invention relates to a Cu—Mg—P based copper alloy material suitable for electric and electronic components such as connectors, lead frames, relays, and switches, and more particularly, to a Cu—Mg—P based copper alloy material in which a tensile strength and a bending elastic limit value are balanced at a high level and a method of producing the same.

Priority is claimed on Japanese Patent Application No. 2009-291542, filed Dec. 23, 2009, the content of which is incorporated herein by reference.

2. Description of the Related Art

Recently, electronic apparatuses such as mobile phones and laptop computers have been small, thin, and light, and smaller terminal and connector components, in which a pitch between electrodes is small, have been used. As a result of such miniaturization, the used material has become thinner. Due to the necessity for maintaining the connection reliability even though the material is thin, a material in which a bending elastic limit value and a higher strength are balanced at a high level is required.

Due to increases in the number of electrodes and an increase in electric current accompanying the increase in apparatus functionality, the generated Joule heat becomes large, and the need for a material with conductivity higher than that of prior cases becomes more pressing. Such a high conductive material is strongly required for a terminal and connector material for vehicles in which the increase in the electric current proceeds rapidly. Hitherto, brass or phosphor bronze has been generally used as such a terminal and connector material.

However, there is a problem that the generally and widely used brass and phosphor bronze cannot sufficiently answer the demand in regards to the connector material. That is, brass is lacking in strength, elasticity, and conductivity, and thus cannot cope with the miniaturization of the connector and the increase in the electric current. Phosphor bronze has higher strength and higher elasticity, but the conductivity thereof is low at about 20% IACS, and it is therefore difficult to cope with the increase in the electric current.

Phosphor bronze has a defect that its migration resistance is unsatisfactory. The migration means a phenomenon where Cu on the positive electrode side is ionized and precipitated into the negative electrode side when dew condensation or the like occurs between electrodes, to finally result in a short circuit between the electrodes. It causes a problem in connectors used in environments with high humidity such as vehicles, and it is a problem requiring care even in connectors in which a pitch between electrodes becomes narrow as a result of miniaturization.

As a material for solving the problems in such brass and phosphor bronze, for example, the applicant proposed a copper alloy using Cu—Mg—P as a main element as described in Japanese Patent Application Laid-Open No.H0 6-340938 (Patent Document 1) and Japanese Patent Application Laid-Open No.H09-157774 (Patent Document 2).

In Patent Document 1, a copper alloy material is disclosed which contains, by weight %, Mg of 0.1 to 1.0%, P of 0.001 to 0.02%, and the balance including Cu and inevitable impurities, in which surface crystal grains have an oval shape, an average short diameter of the oval shape crystal grains is 5 to 20 μm, a value of average long diameter/average short diameter is 1.5 to 6.0, an average crystal grains diameter in the final annealing just before the final cold rolling is adjusted within the range of 5 to 20 μm to form such oval shape crystal grains, and there is little abrasion of a stamping mold at the time of stamping in which a rolling rate in the final cold rolling process is within 30 to 85%.

In Patent Document 2, a thin copper alloy plate is disclosed which has a composition containing Mg of 0.3 to 2 weight %, P of 0.001 to 0.1 weight %, and the balance including Cu and inevitable impurities, in which a content of P is regulated in 0.001 to 0.02 weight %, a content of oxygen is adjusted in 0.0002 to 0.001 weight %, a content of C is adjusted in 0.0002 to 0.0013 weight %, and grain diameters of oxide grains including Mg dispersed in a basis material are adjusted to be 3 μm or smaller, and thus a decrease of a bending elastic limit value after a bending process is less than that of the known thin copper alloy plate. When a connector is produced from the thin copper alloy plate, the obtained connector has superior connector strength to those of the past and there is no case in which it deviates even when it is used under an environment of high temperature and vibration such as rotation of an engine of a vehicle.

It is possible to obtain a copper alloy having excellent strength, conductivity, and the like according to the inventions disclosed in Patent Document 1 and Patent Document 2. However, as electric and electronic apparatuses significantly increase in functionality, the performance of the copper alloy is required to be further improved. Particularly, in regards to the copper alloy used for the connectors and the like, it is important that deterioration does not occur in the use state and that it can be used however high the stress, and a Cu—Mg—P based copper alloy material in which a tensile strength and a bending elastic limit value are balanced at a high level is strongly required.

In the above-described Patent Document, the composition of the copper alloy and the shape of the surface crystal grains are regulated, but a relation between a tensile strength and a bending elastic limit value according to analysis of the fine structure of crystal grains was not described.

SUMMARY OF THE INVENTION

The invention has been made in consideration of such a circumstance, and an object of the invention is to provide a Cu—Mg—P based copper alloy material in which a tensile strength and a bending elastic limit value are balanced at a high level, and a method of producing the same.

Hitherto, plastic deformation of crystal grains has been performed by structural observation of a surface, and there is an electron backscattered diffraction (EBSD) method as a recent technique which can be applied to a strain assessment of crystal grains. The EBSD method is a means for acquiring a crystal orientation from a diffraction image (Kikuchi Pattern) of an electron beam obtained from a surface of a sample when a test piece is installed in a scanning electron microscope (SEM), and can easily measure the orientation of a general metal material. As the processing capability of recent computers is improved, even in a polycrystalline metal material, orientations of about 100 crystal grains existing in a target area of about several mm can be assessed within a practical time, and it is possible to extract a crystal grain boundary from the assessed crystal orientation data on the basis of an image processing technique using a calculator.

When a crystal grain with a desired condition is searched from the image extracted as described above and a modeling part is selected, it is possible to perform an automatic process.

The data of the crystal orientation corresponds to each part (in fact, pixel) of an image, and thus it is possible to extract the crystal orientation data corresponding to the image of the selected part from a data file.

The inventors made extensive research using these facts. Accordingly, they observed a surface of a Cu—Mg—P based copper alloy using the EBSD method with a scanning electron microscope with an electron backscattered diffraction image system, and measured orientations of all the pixels in the measured area. When a boundary in which a misorientation between adjacent pixels is 5° or more was considered as a crystal grain boundary, they found that an area fraction of such crystal grains that the average misorientation between all the pixels in the crystal grain is less than 4°, to the whole measured area had a close relation with the characteristics of tensile strength and bending elastic limit value of the Cu—Mg—P based copper alloy.

A copper alloy material of the invention includes, by mass %, Mg of 0.3 to 2%, P of 0.001 to 0.1%, and the balance including Cu and inevitable impurities. The alloy is characterized by having an area fraction of such crystal grains that an average misorientation between all the pixels in each crystal grain is less than 4° is 45 to 55% of a measured area, when orientations of all the pixels in the measured area of the surface of the copper alloy material are measured in a step size of 0.5 μm by an EBSD method with a scanning electron microscope of an electron backscattered diffraction image system and a boundary in which a misorientation between adjacent pixels is 5° or more is considered as a crystal grain boundary, and a tensile strength is 641 to 708 N/mm$^2$, and a bending elastic limit value is 472 to 503 N/mm$^2$.

When the area fraction of the crystal grains in which the average misorientation between all the pixels in the crystal grain is less than 4° is lower than 45% or higher than 55% of the measured area, both the tensile strength and the bending elastic limit value are decreased. When the area fraction is 45% to 55% of the appropriate value, the tensile strength is 641 to 708 N/mm$^2$, the bending elastic limit value is 472 to 503 N/mm$^2$, and thus the tensile strength and the bending elastic limit value are balanced at a high level.

The copper alloy material of the invention may further contain, by mass %, Zr of 0.001 to 0.03%.

The addition of Zr of 0.001 to 0.03% contributes to improvement of the tensile strength and the bending elastic limit value.

In a method of producing the copper alloy material of the invention, when a copper alloy is produced by a process including hot rolling, solution treatment, finishing cold rolling, and low temperature annealing in this order, the hot rolling is performed under the conditions that a hot rolling starting temperature is 700° C. to 800° C., a total hot rolling reduction ratio is 90% or higher, an average rolling reduction ratio per 1 pass is 10% to 35%, a Vickers hardness of a copper alloy plate after the solution treatment is adjusted to be 80 to 100 Hv, and the low temperature annealing is performed at 250° C. to 450° C. for 30 to 180 seconds.

To stabilize the structure of the copper alloy and to balance the tensile strength and the bending elastic limit value at the high level, it is necessary to appropriately adjust terms and conditions of the hot rolling, the solution treatment, and the cold rolling, such that the Vickers hardness of the copper alloy plate after the solution treatment is 80 to 100 Hv. In addition, it is necessary to perform low temperature annealing at 250 to 450° for 30 to 180 seconds, such that the area fraction of crystal grains in which the average misorientation between all the pixels in each crystal grain is less than 4° is 45 to 55% of the measured area, when the orientations of all the pixels in the measured area of the surface of the copper alloy material are measured by an EBSD method with the scanning electron microscope of the electron backscattered diffraction image system and the boundary in which the misorientation between adjacent pixels is 5° or more is considered as the crystal grain boundary, and the tensile strength is 641 to 708 N/mm$^2$, and the bending elastic limit value is 472 to 503 N/mm$^2$.

According to the invention, it is possible to obtain the Cu—Mg—P based copper alloy material in which the tensile strength and the bending elastic limit value are balanced at the high level.

DETAILED DESCRIPTION OF THE INVENTION

Figure 1:
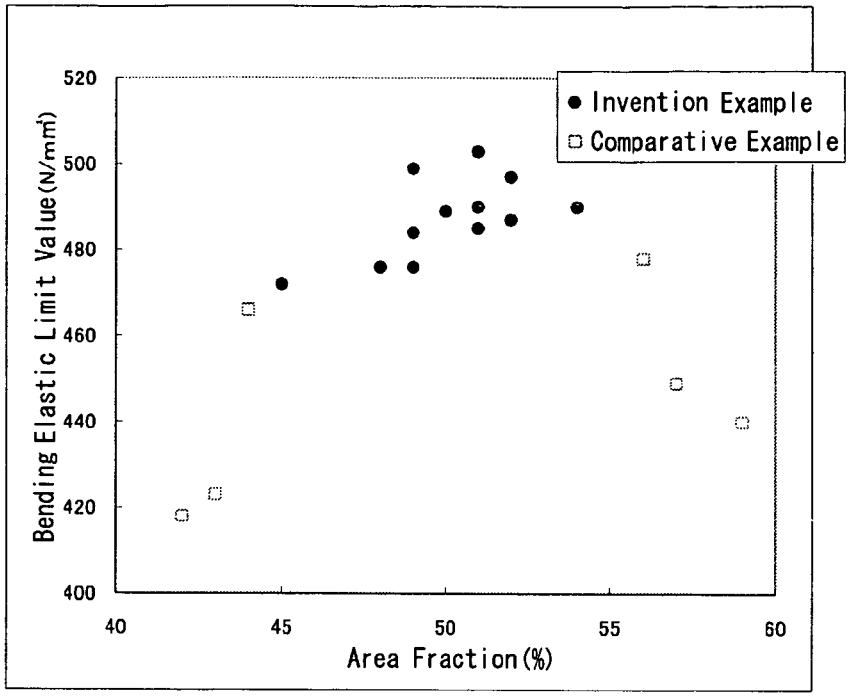
FIG. 1 is a graph illustrating a relation between an area fraction to the whole measured area of such crystal grains that an average misorientation between all the pixels in the crystal grain is less than 4° and a bending elastic limit value (Kb), when orientations of all the pixels in the measured area of the surface of the copper alloy material are measured by an EBSD method with a scanning electron microscope of an electron backscattered diffraction image system and a boundary in which a misorientation between adjacent pixels is 5° or more is considered as a crystal grain boundary.

Hereinafter, embodiments of the invention will be described.

A copper alloy material of the invention has a composition including, mass %, Mg of 0.3 to 2%, P of 0.001 to 0.1%, and the balance including Cu and inevitable impurities.

Mg is solid-solved into a basis of Cu to improve strength without damaging conductivity. P undergoes deoxidation at the time of melting and casting, and improves strength in a state of coexisting with an Mg component. Mg and P are contained in the above-described range, thereby effectively exhibiting such characteristics.

By mass %, Zr of 0.001 to 0.03% may be contained, and the addition of Zr in this range is effective for the improvement of the tensile strength and the bending elastic limit value.

In the copper alloy material, an area fraction of such crystal grains that an average misorientation between all the pixels in the crystal grain is less than 4° is 45 to 55% of a measured area, when orientations of all the pixels in the measured area of the surface of the copper alloy material are measured by an EBSD method with a scanning electron microscope of an electron backscattered diffraction image system and a boundary in which a misorientation between adjacent pixels is 5° or more is considered as a crystal grain boundary, a tensile strength is 641 to 708 N/mm$^2$, and a bending elastic limit value is 472 to 503 N/mm$^2$.

The area fraction of the crystal grains in which the average misorientation between all the pixels in the crystal grain is less than 4° was acquired as follows.

As a preliminary process, a sample of 10 mm×10 mm was immersed in 10% sulfuric acid for 10 minutes and was washed with water, water was sprinkled by air blowing, and then the sample after the water sprinkling was subjected to a surface treatment by a flat milling (ion milling) device manufactured by Hitachi High-Technologies Corporation for an acceleration voltage of 5 kV at an incident angle of 5° for an irradiation time of 1 hour.

Next, the surface of the sample was observed by a scanning electron microscope S-3400N manufactured by Hitachi High-Technologies Corporation attached to an EBSD system manufactured by TSL Corporation. Conditions of the observation were an acceleration voltage of 25 kV and a measurement area of 150 μm×150 μm.

As a result of the observation, the area fraction of the crystal grains in which the average misorientation between all the pixels in the crystal grain is less than 4° to the whole measured area was acquired with the following conditions.

The orientations of all the pixels in the measured area range were measured in a step size of 0.5 μm, and a boundary in which a misorientation between adjacent pixels was 5° or more was considered as a crystal grain boundary. Next, as for each crystal grain surrounded with the crystal grain boundary, an average value (GOS: Grain Orientation Spread) of misorientations between all the pixels in the crystal grain was calculated by Formula (1), the area of the crystal grains in which the average value is less than 4° was calculated, and it was divided by the whole measured area, thereby acquiring the area of the crystal grains in which the average misorientation in the crystal grain forming all the crystal grains is less than 4°. Connections of 2 or more pixels were considered as the crystal grains.

$$GOS = \frac{\sum_{i,j=1}^{n} \alpha_{ij(i \neq j)}}{n(n-1)} \quad (1)$$

In the formula, i and j denote numbers of pixels in crystal grains. n denotes the number of pixels in crystal grains. $\alpha_{ij}$ denotes a misorientation between pixels i and j.

In the copper alloy material of the invention, the area fraction of the crystal grains in which the average misorientation between all the pixels in the crystal grain is less than 4° acquired as described above is 45 to 55% of the measured area, strain is hardly accumulated in the crystal grains, cracks hardly occur, and a tensile strength and a bending elastic limit value are balanced at a high level.

The copper alloy material with such a configuration can be produced, for example, by the following production process.

"melting and casting→hot rolling→cold rolling→solution treatment→intermediate cold rolling→finishing cold rolling→low temperature annealing"

Although not described in the process, facing is performed after the hot rolling as necessary, and acid cleaning, grinding, or additional degreasing may be performed after each heat treatment as necessary.

Hereinafter, essential processes will be described.

"Hot Rolling, Cold Rolling, Solution Treatment"

To stabilize the structure of the copper alloy and to balance the tensile strength and the bending elastic limit value at the high level, it is necessary to appropriately adjust terms and conditions of the hot rolling, the cold rolling, and the solution treatment, such that the Vickers hardness of the copper alloy plate after the solution treatment is 80 to 100 Hv.

Among them, it is important to perform the hot rolling under the conditions that a hot rolling starting temperature is 700° C. to 800° C., a total hot rolling reduction ratio is 90% or higher, and an average hot rolling reduction ratio per 1 pass is 10% to 35%. When the average hot rolling reduction ratio per 1 pass is lower than 10%, workability in the following process deteriorates. When the average hot rolling reduction ratio per 1 pass is higher than 35%, material cracking easily occurs. When the total hot rolling reduction ratio is lower than 90%, the added element is not uniformly dispersed, and splitting easily occurs in the material. When the hot rolling starting temperature is lower than 700° C., the added element is not uniformly dispersed, and splitting easily occurs in the material. When the hot rolling starting temperature is higher than 800° C., the heat cost is increased, which is economically wasteful.

"Intermediate Cold Rolling, Finishing Cold Rolling"

The intermediate cold rolling and the finishing cold rolling are performed at a cold rolling reduction ratio of 50 to 95%.

"Low Temperature Annealing"

By performing the low temperature annealing at 250 to 450° C. for 30 to 180 seconds after the finishing cold rolling, the structure of the copper alloy is stabilized, the tensile strength and the bending elastic limit value are balanced at a high level, and an area fraction of such crystal grains that an average misorientation between all the pixels in the crystal grain is less than 4° is 45 to 55% of a measured area, when orientations of all the pixels in the measured area of the surface of the copper alloy material are measured by an EBSD method with a scanning electron microscope of an electron backscattered diffraction image system and a boundary in which a misorientation between adjacent pixels is 5° or more is considered as a crystal grain boundary.

When the temperature of the low temperature annealing is lower than 250° C., the characteristic of the bending elastic limit value is not improved. When the temperature is higher than 450° C., a weak and coarse Mg compound is formed leading to a decrease in the tensile strength. Similarly, when the time of the low temperature annealing is less than 30 seconds, the characteristic of the bending elastic limit value is not improved. When the time is more than 180 seconds, a weak and coarse Mg compound is formed leading to a decrease of the tensile strength.

EXAMPLE

Hereinafter, characteristics of examples of the invention will be described in comparison with comparative examples.

A copper alloy with a composition shown in Table 1 was melted under a reduction atmosphere by an electric furnace, and a cast ingot with a thickness of 150 mm, a width of 500 mm, and a length of 3000 mm was produced. The produced cast ingot was subjected to hot rolling at a hot rolling starting temperature, a total hot rolling reduction ratio, and an average hot rolling reduction ratio shown in Table 1, to be a copper alloy plate with a thickness of 7.5 mm to 18 mm. Oxidation scale on both surfaces of the copper alloy plate was removed by a fraise by 0.5 mm, cold rolling was performed at a cold rolling reduction ratio of 85% to 95%, solution treatment was performed at 750° C., finishing cold rolling was performed at a cold rolling reduction ratio of 70 to 85%, thereby producing a thin cold rolling plate of 0.2 mm. Then, low temperature annealing shown in Table 1 was performed, thereby producing thin Cu—Mg—P based copper alloy plates shown in Invention Examples 1 to 12 and Comparative Examples 1 to 6 in Table 1.

Vickers hardness of the copper alloy plate after the solution treatment shown in Table 1 was measured on the basis of JIS-Z2244.

TABLE 1

| | Mg (%) | P (%) | Zr (%) | Hot Rolling Starting Temp. (° C.) | Total Hot Rolling Reduction Ratio (%) | Average Hot Rolling Reduction Ratio (%) | Vickers Hardness After Solution Treatment (HV) | Low-Temp. Annealing Temp. (° C.) | Low-Temp. Annealing Time (sec) |
|---|---|---|---|---|---|---|---|---|---|
| Invention Ex. 1 | 1.0 | 0.01 | | 750 | 94 | 17 | 90 | 350 | 90 |
| Invention Ex. 2 | 1.0 | 0.01 | | 750 | 94 | 17 | 92 | 450 | 30 |
| Invention Ex. 3 | 0.7 | 0.005 | 0.01 | 750 | 94 | 23 | 93 | 450 | 30 |
| Invention Ex. 4 | 0.7 | 0.005 | 0.001 | 750 | 93 | 23 | 95 | 250 | 180 |
| Invention Ex. 5 | 0.3 | 0.005 | | 750 | 93 | 34 | 83 | 250 | 180 |
| Invention Ex. 6 | 0.3 | 0.001 | | 800 | 93 | 34 | 81 | 350 | 60 |
| Invention Ex. 7 | 0.5 | 0.05 | 0.02 | 750 | 90 | 25 | 87 | 350 | 90 |
| Invention Ex. 8 | 0.5 | 0.05 | | 800 | 90 | 25 | 84 | 250 | 180 |
| Invention Ex. 9 | 1.4 | 0.02 | | 750 | 95 | 30 | 96 | 250 | 180 |
| Invention Ex. 10 | 1.4 | 0.02 | | 700 | 95 | 30 | 95 | 350 | 90 |
| Invention Ex. 11 | 2.0 | 0.1 | 0.03 | 750 | 94 | 14 | 99 | 450 | 30 |
| Invention Ex. 12 | 2.0 | 0.01 | 0.01 | 750 | 94 | 11 | 97 | 350 | 90 |
| Comparative Ex. 1 | 1.0 | 0.01 | | 850 | 94 | 24 | 103 | 350 | 60 |
| Comparative Ex. 2 | 0.7 | 0.005 | | 750 | 88 | 25 | 91 | 200 | 60 |
| Comparative Ex. 3 | 0.3 | 0.002 | | 750 | 93 | 22 | 83 | 500 | 60 |
| Comparative Ex. 4 | 2.3 | 0.15 | | 750 | 94 | 25 | 104 | 350 | 300 |
| Comparative Ex. 5 | 0.2 | 0.0007 | | 750 | 93 | 34 | 79 | 350 | 10 |
| Comparative Ex. 6 | 0.7 | 0.008 | 0.04 | 750 | 93 | 17 | 95 | 200 | 250 |

A result obtained by performing the following various tests on the thin plates shown in Table 1 was shown in Table 2.

(Area Fraction)

As a preliminary process, a sample of 10 mm×10 mm was immersed in 10% sulfuric acid for 10 minutes and was washed with water, water was sprinkled by air blowing, and then the sample after the water sprinkling was subjected to a surface treatment by a flat milling (ion milling) device manufactured by Hitachi High-Technologies Corporation for an acceleration voltage of 5 kV at an incident angle of 5° for an irradiation time of 1 hour.

Next, the surface of the sample was observed by a scanning electron microscope S-3400N manufactured by Hitachi High-Technologies Corporation attached to an EBSD system manufactured by TSL Corporation. Conditions of the observation were an acceleration voltage of 25 kV and a measurement area of 150 μm×150 μm (including 5000 or more crystal grains).

As a result of the observation, the area fraction of the crystal grains in which the average misorientation between all the pixels in the crystal grain is less than 4° to the whole measured area was acquired with the following conditions.

The orientations of all the pixels in the measured area range were measured in a step size of 0.5 μm, and a boundary in which a misorientation between adjacent pixels was 5° or more was considered as a crystal grain boundary. Next, as for each crystal grain surrounded with the crystal grain boundary, an average value of misorientations between all the pixels in the crystal grain was calculated by Formula 1, the area of the crystal grains in which the average value is less than 4° was calculated, and it was divided by the whole measured area, thereby acquiring the area fraction of the crystal grains in which the average misorientation in the crystal grain is less than 4° to all the crystal grains. Connections of 2 or more pixels were considered as the crystal grains.

The measurement was performed 5 times by this method while changing the measurement parts and an average value of area fractions was considered as the area fraction.

(Mechanical Strength)

Mechanical strength was measured with a test piece of JIS No. 5.

(Bending Elastic Limit Value)

A permanent deflection amount was measured by a moment type test on the basis of JIS-H3130, and Kb0.1 (surface maximum stress value at a fixed end corresponding to permanent deflection amount of 0.1 mm) at R.T. was calculated.

(Conductivity)

Conductivity was measured on the basis of JIS-H0505.

(Stress Easing Rate)

A test piece having a size of a width of 12.7 mm and a length of 120 mm (hereinafter, the length of 120 mm is referred to as L0) was used, the test piece was bent and set on a jig having a horizontal and longitudinal groove of a length of 110 mm and a depth of 3 mm such that the center of the test piece was swollen upward (a distance of 110 mm between both ends of the test piece at this time is referred to as L1), this state was kept and heated at a temperature of 170° C. for 1000 hours, and, after heating, a distance (hereinafter, referred to as L2) between both ends of the test piece in a state where it is detached from the jig was measured, thereby calculating the stress easing rate by a calculation formula of (L0–L2)/(L0–L1)×100%.

TABLE 2

| | Area Fraction (%) | Tensile Strength ($N/mm^2$) | Bending Elastic Limit Value ($N/mm^2$) | Conductivity (% IACS) | Stress Easing Rate (%) |
|---|---|---|---|---|---|
| Invention Ex. 1 | 51 | 676 | 490 | 61 | 15 |
| Invention Ex. 2 | 52 | 679 | 487 | 61 | 16 |
| Invention Ex. 3 | 49 | 668 | 489 | 63 | 12 |
| Invention Ex. 4 | 50 | 663 | 484 | 64 | 13 |
| Invention Ex. 5 | 48 | 644 | 476 | 67 | 15 |
| Invention Ex. 6 | 45 | 641 | 472 | 68 | 15 |
| Invention Ex. 7 | 51 | 650 | 485 | 66 | 11 |
| Invention Ex. 8 | 49 | 657 | 476 | 65 | 13 |
| Invention Ex. 9 | 54 | 687 | 490 | 54 | 18 |
| Invention Ex. 10 | 52 | 684 | 497 | 54 | 16 |
| Invention Ex. 11 | 51 | 708 | 503 | 49 | 11 |
| Invention Ex. 12 | 49 | 696 | 499 | 50 | 12 |
| Comparative Ex. 1 | 56 | 604 | 478 | 54 | 18 |
| Comparative Ex. 2 | 57 | 572 | 449 | 63 | 17 |
| Comparative Ex. 3 | 42 | 564 | 418 | 68 | 14 |
| Comparative Ex. 4 | 44 | 585 | 466 | 47 | 20 |
| Comparative Ex. 5 | 43 | 536 | 423 | 68 | 17 |
| Comparative Ex. 6 | 59 | 579 | 440 | 63 | 12 |

From these results, FIG. 1 is a graph illustrating a relation between an area fraction to the whole measured area of such crystal grains that an average misorientation between all the pixels in the crystal grain is less than 4° and a bending elastic limit value (Kb), when orientations of all the pixels in the measured area of the surface of the copper alloy material are measured by an EBSD method with a scanning electron microscope of an electron backscattered diffraction image system and a boundary in which a misorientation between adjacent pixels is 5° or more is considered as a crystal grain boundary. When the area fraction is within the range of 45 to 55%, it can be seen to show a high bending elastic limit value (472 to 503 $N/mm^2$ in Table 2).

Among them, the bending elastic limit value of the alloy to which Zr was added was improved to 484 to 503 $N/mm^2$.

Figure 2:
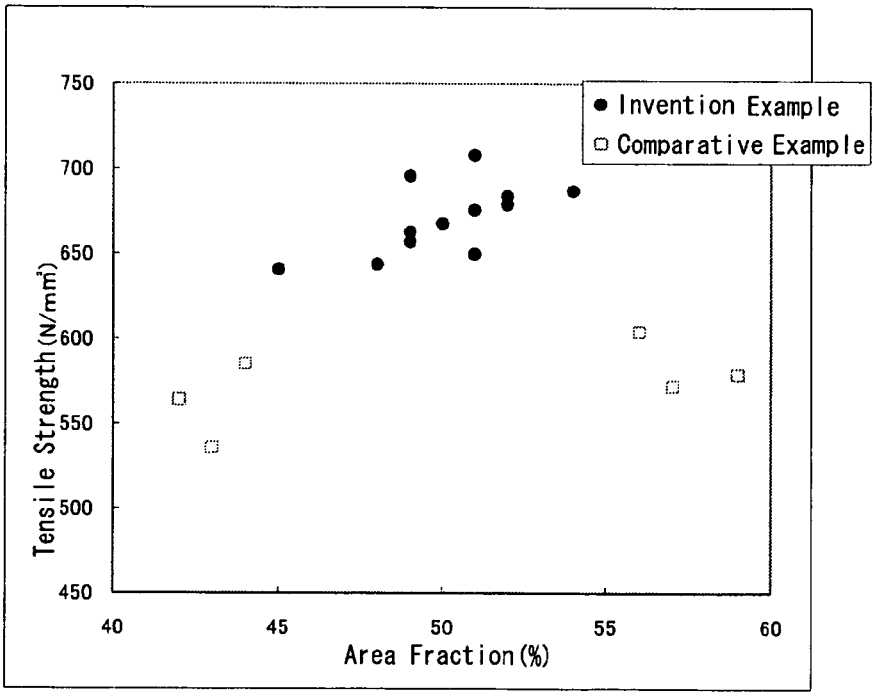
FIG. 2 is a graph illustrating a relation between an area fraction to the whole measured area of such crystal grains that an average misorientation between all the pixels in the crystal grain is less than 4° and a tensile strength, when orientations of all the pixels in the measured area of the surface of the copper alloy material are measured by an EBSD method with a scanning electron microscope of an electron backscattered diffraction image system and a boundary in which a misorientation between adjacent pixels is 5° or more is considered as a crystal grain boundary.

From the results, FIG. 2 is a graph illustrating a relation between an area fraction to the whole measured area of such crystal grains that an average misorientation between all the pixels in the crystal grain is less than 4° and a tensile strength, when orientations of all the pixels in the measured area of the surface of the copper alloy material are measured by an EBSD method with a scanning electron microscope of an electron backscattered diffraction image system and a boundary in which a misorientation between adjacent pixels is 5° or more is considered as a crystal grain boundary. When the area fraction is within the range of 45 to 55%, it can be seen to show a high tensile strength (641 to 708 $N/mm^2$ in Table 2).

Among them, the tensile strength of the alloy to which Zr was added was improved to 650 to 708 $N/mm^2$.

As is apparent from the results of Table 2, FIG. 1, and FIG. 2, in the Cu—Mg—P based copper alloy of the invention, it is obvious that the tensile strength and the bending elastic limit value are balanced at a high level, and particularly, it can be seen that the copper alloy is appropriately used for electric and electronic components such as connectors, lead frames, relays, and switches in which the bending elastic limit value characteristic is important.

The production method according to the embodiment of the invention has been described, but the invention is not limited to the description, and may be variously modified within the scope which does not deviate from the concept of the invention.

For example, the process in order of "melting and casting→hot rolling→cold rolling→solution treatment→intermediate cold rolling→finishing cold rolling→low temperature annealing" was described, but hot rolling, solution treatment, finishing cold rolling, and low temperature annealing may be performed in this order. In this case, for the other conditions such as a hot rolling starting temperature of the hot rolling, a total hot rolling reduction ratio, an average hot rolling reduction ratio per 1 pass, and a temperature and a time of the low temperature annealing, the general production conditions may be applied.

The invention claimed is:

1. A copper alloy plate consisting of, by mass %:

Mg of 0.3 to 2%;

P of 0.001 to 0.1%;

Zr of 0.001 to 0.03%; and the balance including Cu and inevitable impurities, wherein an area fraction of those crystal grains of the copper alloy material, wherein an average misorientation between all pixels in each crystal grain is less than 4°, is 45 to 55% of a measured area, when wherein the measurement of orientations of all the pixels in the measured area of the surface of the copper alloy material is carried out a) in a step size of 0.5 μm by an EBSD method with a scanning electron microscope of an electron backscattered diffraction image system and b) a boundary in which a misorientation between adjacent pixels is 5° or more is considered as a crystal grain boundary, and wherein a tensile strength of the copper alloy material is 650 to 708 $N/mm^2$, a bending elastic limit value is 484 to 503 $N/mm^2$, and a conductivity is 49 to 68% IACS.

2. A method of producing the copper alloy plate according to claim 1, wherein when a copper alloy is produced by a process including hot rolling, solution treatment, finishing cold rolling, and low temperature annealing in this order, the hot rolling is performed under the conditions that a hot rolling starting temperature is 700° C. to 800° C., a total hot rolling reduction ratio is 90% or higher, an average hot rolling reduction ratio per 1 pass is 10% to 35%, a Vickers hardness of a copper alloy plate after the solution treatment is adjusted to be 80 to 100 Hv, and the low temperature annealing is performed at 250° C. to 450° C. for 30 to 180 seconds.

3. The copper alloy plate according to claim 1, wherein plate is a thin plate of about 0.2 mm.

* * * * *